United States Patent [19]

Beatenbough et al.

[11] Patent Number: 4,997,035

[45] Date of Patent: Mar. 5, 1991

[54] JOINT CREVICE CORROSION INHIBITOR

[75] Inventors: Paul K. Beatenbough, Medina; David J. Twichell, Ashville, both of N.Y.; Lavoyce G. Dey, Youngsville, Pa.

[73] Assignee: Blackstone Corporation, Jamestown, N.Y.

[21] Appl. No.: 503,468

[22] Filed: Apr. 2, 1990

[51] Int. Cl.[5] ..... F28F 9/02

[52] U.S. Cl. ..... 165/173; 165/149

[58] Field of Search ..... 165/148, 149, 134.1, 165/173, 905

[56] References Cited

U.S. PATENT DOCUMENTS

| | | | |
|---|---|---|---|
| 4,023,618 | 5/1977 | Kun et al. | 165/175 |
| 4,289,507 | 9/1981 | Cadars et al. | 55/195 |
| 4,546,823 | 10/1985 | Melnyk | 165/149 |
| 4,576,223 | 3/1986 | Humpolik et al. | 165/79 |
| 4,600,051 | 2/1986 | Wehrman | 165/149 |
| 4,651,815 | 3/1987 | Logic et al. | 165/76 |
| 4,917,182 | 4/1990 | Beamer | 165/173 |

FOREIGN PATENT DOCUMENTS

| | | | |
|---|---|---|---|
| 3222278 | 12/1983 | Fed. Rep. of Germany | 165/149 |

*Primary Examiner*—Stephen M. Hepperle
*Assistant Examiner*—Allen J. Flanigan
*Attorney, Agent, or Firm*—Bean, Kauffman & Spencer

[57] ABSTRACT

This invention is to an improved method for reducing crevice corrosion in assembly joints of aluminum fluid handling devices, the improvement comprising, providing a series of spaced ribs at the assembly joint configured to intermittently resist engagement of components along an elongated assembly crevice sufficient to segment the crevice into a plurality of minor assembly crevices dimensioned to permit substantial mixing of fluid within the minor crevices with fluid being handled by the device. The invention has particular utility in automotive heat exchangers wherein crevices at joints where polymeric tanks are assembled to aluminum metal headers are susceptible to crevice corrsion.

26 Claims, 2 Drawing Sheets

JOINT CREVICE CORROSION INHIBITOR

FIELD OF INVENTION

This invention relates to a new corrosion inhibiting joint configuration for devices wherein corrosion caused by the stagnation of electrolytically conductive fluids in an aluminum joint is a problem. The invention has particular utility in automotive heat exchangers wherein crevices at joints between polymeric tanks and aluminum metal headers are susceptible to crevice corrosion.

BACKGROUND OF THE INVENTION

Aluminum is subject to a phenomenon known as crevice corrosion. This phenomena is well known and occurs in crevices at joints of fluid handling devices made of aluminum. Typically, crevice corrosion manifests itself by the appearance of pitting of the aluminum metal at a crevice where aluminum metal is joined or joins another material in gasket sealed arrangement. Such pitting can eventually lead to the formation of small holes in the aluminum and to a leakage failure at the crevice.

In the manufacture of fluid handling devices such as automotive heat exchangers and the like, it is common practice to assemble a first aluminum component such as a heat exchanger header sheet together with a second component manufactured from the same or another material, such as a polymeric header tank or the like. For manufacturing convenience, assembly can involve locking the second component in fluid tight, gasket sealed relationship with the first aluminum component by crimping or otherwise forming the first aluminum component about an edge or surface of the second component to deflect a sealing gasket between the components and thus form a fluid seal therebetween. Such assembly typically results in the formation of an elongated crevice between surfaces of the two components which when formed within the fluid handling compartment can be a site of corrosion failure of an aluminum component.

It has been found that with aluminum materials, when a fluid containing dissolved oxygen and an electrolyte stagnates in a crevice, the crevice can corrode by what is believed to be an electrolytic activity. In typical automotive heat exchanger applications, it is not unusual for automotive water-antifreeze solutions to contain enough dissolved oxygen and impurities to foster an electrolytic activity and promote crevice corrosion.

It is well known that dissolved oxygen will typically react with aluminum components to form an oxide on an exposed aluminum wall. Generally, it is anticipated that such reaction will produce a barrier coating which will act in a self limiting manner to resist corrosion failure. One recurring problem however is that of joint crevice corrosion. It has been found that material thicknesses adequate to avoid general failure of the component from anticipated mechanical load and corrosion due to the bulk fluid may be inadequate to protect the component from crevice corrosion.

We have found that crevice corrosion can be affected by the configuration of the crevice in an automotive cooling system. When the crevice is configured to allow a water-antifreeze solution to be held stagnant within the crevice, corrosion appears to occur much more rapidly than if the solution within the crevice substantially intermixes with the bulk of the fluid being handled by the system. Though we do not wish to be bound by the following, it is believed that when a water/antifreeze solution is isolated in a crevice such that it does not substantially mix with the bulk of the mixture being circulated through the assembly that crevice corrosion is electrolytically fostered. It is believed that this is at least in part due to an inhibited replacement of depleted dissolved oxygen in stagnant, isolated fluid in the crevice. By that is meant that as the dissolved oxygen in stagnant, isolated fluid of a crevice reacts with the aluminum to form an oxide or reacts with other reactants, it is not rapidly replenished with dissolved oxygen from the circulating bulk mixture because of its stagnant isolation. Thus, the stagnant fluid within the crevice is oxygen deficient as compared to the fluid within the bulk circulating mixture.

It is known that oxygen deficient water is electro-positive in relation to water containing dissolved oxygen. It is also known that in an electrolytic environment, electrons will flow to an electro-positive portion of the environment tending toward charge conservation of the overall environment. Thus, in a bulk mixture wherein oxygen in a fluid medium is reacting with aluminum or other reactants, oxygen from throughout the bulk mixture would continually replenish oxygen at the reaction interface thus tending to stabilize the mixture. It is believed however, that within the electro-positive environment of the oxygen depleted mixture of stagnant, isolated fluid in the crevice, the stagnation of the fluid in the crevice inhibits dissolved oxygen replenishment from the bulk mixture. This inhibition to oxygen replinishment interrupts the normal charge conservation mechanism, and electron flow from the aluminum to the water within the crevice becomes the compensating charge conservation mechanism. Such compensating flow of electrons from the wall to the fluid, can act to remove aluminum from a wall of the crevice resulting in the formation of pits. The pits may eventually penetrate the wall of the crevice and constitute sufficient crevice corrosion to cause failure of the assembly.

An object of the invention is to provide a method for reducing crevice corrosion in aluminum devices.

Another object of the invention is to provide an automotive heat exchanger having corrosion inhibited crevices therein.

These and other objects of the invention will become apparent from the following description.

SUMMARY OF THE INVENTION

This invention relates to an improved method for reducing crevice corrosion in fluid handling devices wherein an aluminum surface of a first component is joined to a second component in a gasket sealed, assembly joint comprising an elongated assembly crevice; the improvement comprising, providing a series of spaced ribs at said assembly joint, said ribs being configured to intermittently resist engagement of said second component to said first component along said elongated assembly crevice sufficient to segment said elongated assembly crevice into a plurality of minor assembly crevices, interspaced with rib crevices, a plurality of said minor assembly crevices being dimensioned to permit substantial mixing of fluid within said minor crevices with fluid being handled by the device.

Aluminum metal containing fluid handling devices comprising such ribs and manufactured in accord with such method are resistant to crevice corrosion. The invention has particular utility in automotive heat exchangers wherein crevices at joints where polymeric tanks are assembled to aluminum metal headers are susceptible to crevice corrosion.

DETAILED DESCRIPTION OF THE INVENTION

Figure 1:
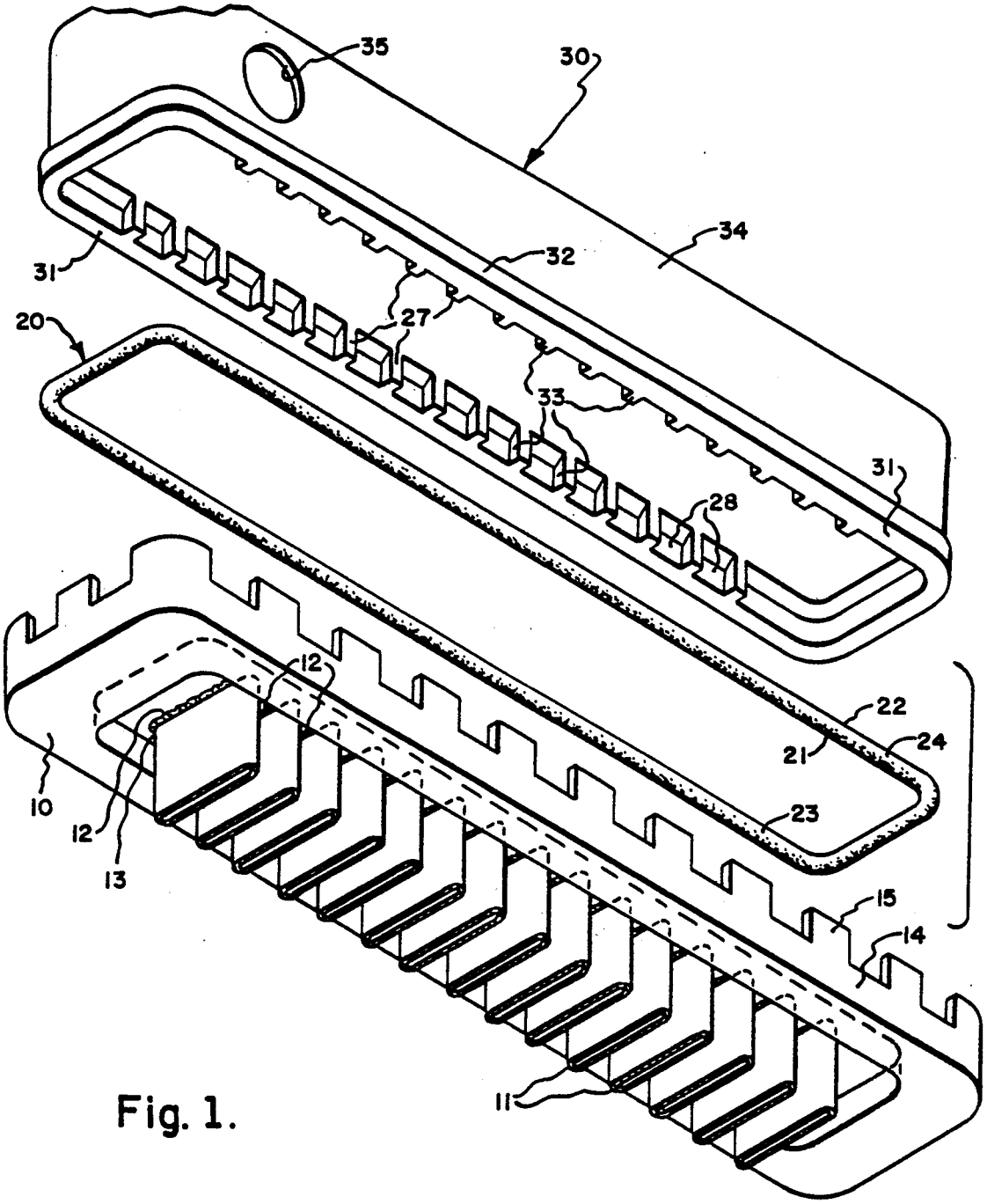
FIG. 1 comprises an exploded perspective view of an automotive heat exchanger assembly comprising an embodiment of the invention.
Figure 3:
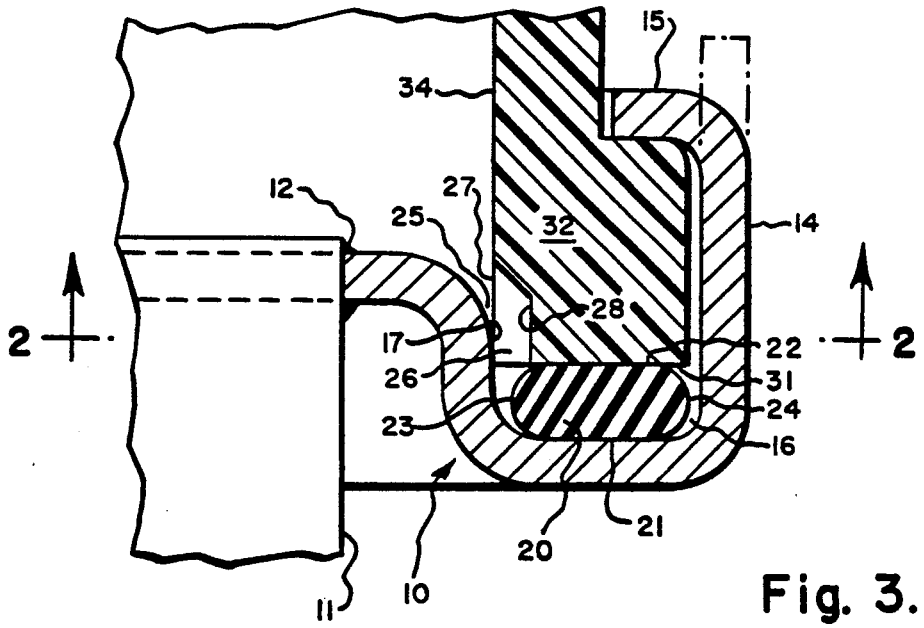
FIG. 3, comprises a partial sectional, plan view of the automotive heat exchanger of FIG. 1 taken approximately along line 3—3.
Figure 2:
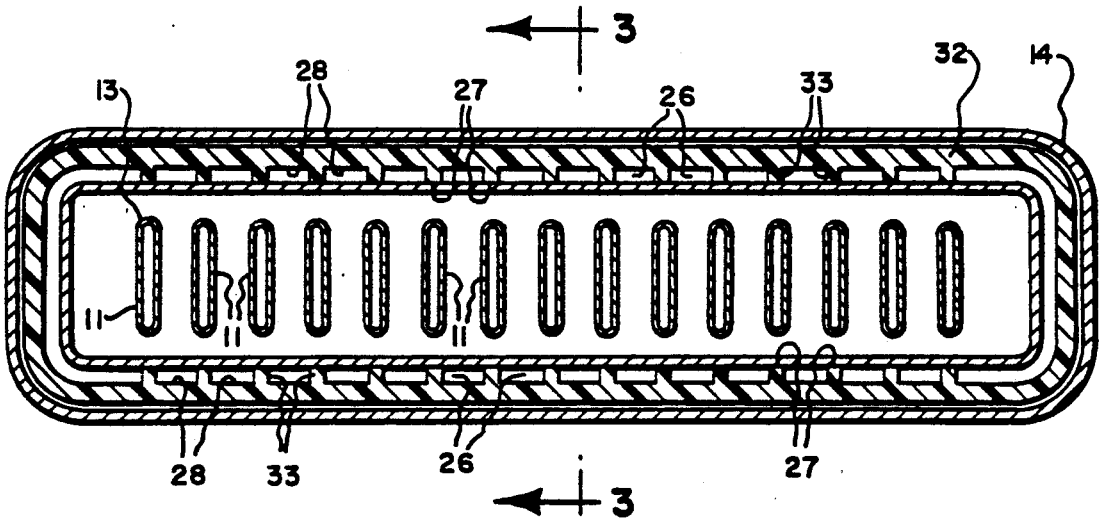
FIG. 2, comprises a sectioned plan view of the automotive heat exchanger of FIG. 1 taken approximately along line 2—2.

An exemplary embodiment of an automotive radiator made according to the invention is illustrated in FIGS. 1-3. It should be understood however that the present invention can be utilized in a plurality of other applications where crevice corrosion in fluid handling devices represents a problem.

In the description that follows, by the term fluid handling device is meant a device useful for handling fluids, particularly those assemblies through which fluids flow from one point to another and most particularly those assemblies that separate fluids from other environments. The fluid handling device is most frequently an assembly of components which contains an aluminum component, or, an aluminum surface, that contacts the fluid being handled by the device at a crevice containing joint. The assembly may comprise multiple components of varying materials, providing there is a gasket sealed joint comprising a crevice wherein joint crevice corrosion is a potential problem. A particularly preferred assembly is an automotive radiator assembly comprising an aluminum containing heat exchanger header sheet, assembled to a polymeric header tank.

By the term joint is meant any assembly joint in the device at an aluminum or aluminum surfaced component, component part or section. The invention has particular application where a joint is between aluminum and a dissimilar material such as a different metal or a polymer, but also has application at aluminum to aluminum assembly joints.

The term gasket sealed means that the joint comprises a gasket, generally placed between the components to attain a fluid seal and/or restriction at the joint. The gasket can be of any convenient material, including cork, paper and various polymers such as elastomers, silicon polymers or even metals and the like. The terms fluid seal or restriction refers to the quality of the joint, that is that the joint is generally intended to resist leakage of fluid through the joint. The joint need not be impermeable to fluid flow, but must be at least so resistant that joint crevice corrosion comprises a problem that could result in failure of the joint.

By the term assembly crevice is meant a hollow depression between two materials at a joint, where fluid being handled by the device can accumulate and be generally isolated from the flow of fluid in the assembly. An assembly crevice is typically formed through the joining of components. In a typical embodiment of the invention the apex of the assembly crevice comprises a gasket seal of the assembly with an aluminum surface of one component comprising an interior crevice wall and a surface of a second component comprising another interior crevice wall. The interior sides of the depression are gradually sloped away from each other so that the crevice generally comprises a depression of sufficient narrowness in relation to its depth that fluid can be isolated therein from the general flow of fluid within the assembly. By rib crevice is meant an assembly crevice formed at a rib surface, through the joining of components comprising a rib.

By isolated is meant that the fluid within the crevice is so displaced from the flow stream of fluid within the assembly that it can act as a separate macro system within the assembly and may not fully participate in the dynamics of the fluid flow of the system. Isolated fluid can interface with the bulk of the fluid being handled by the device, but the interface is typically not sufficient to allow substantial immediate mixing of the fluids or their components and is typically stagnant relative to the bulk of the fluid being handled by the device. Thus, isolated fluid is not immediately stabilized to concentration changes of components in the flowing bulk fluid, or in the isolated fluid, but is slow to respond to such changes. The depletion of entrained gaseous components in the isolated fluid is not immediately replaced by the flowing bulk fluid because of the insufficient interface.

Referring now to FIG. 1, which comprises an embodiment of the invention being an inlet end section of a typical automotive radiator assembly illustrated in exploded perspective view. Therein, heat exchanger inlet header sheet 10, is illustrated as having a plurality of hollow heat exchange structures 11, joined at inlet header sheet openings 13 (shown in FIG. 2), to inlet header sheet 10 by braze welds 12, said header sheet 10 comprising retaining wall 14 with deformable attachment ends 15. The hollow heat exchange structures extend from inlet header sheet 10 to a heat exchanger outlet header assembly which is not shown. Gasket 20 is configured to be inserted into attachment slot 16 (shown in FIG. 3) of header sheet 10, the exterior boundary of which slot is defined by the interior wall surface of retaining wall 14 of inlet header sheet 10. Gasket 20 comprises compression surfaces 21 and 22, interior side 23 and exterior side 24. Inlet header tank 30 comprises gasket engagement surface 31, header tank attachment foot 32, ribs 33, header tank defining wall 34 and inlet 35.

Inlet header sheet 10, gasket 20 and inlet header tank 30 are assembled together with gasket 20 being inserted into attachment slot 16 of inlet header sheet 10 with compression surface 21 of gasket 20, engaging an interior surface of the attachment slot. Gasket engagement surface 31 of inlet header tank 30 engages compression surface 22 of gasket 10 and deflects the gasket to attain a sealed assembly with inlet header sheet 10. Attachment ends 15 of retaining wall 14 of inlet header sheet 10 are crimped over attachment footer 32 of inlet header tank 30 to compressingly engage and retain inlet header tank 30 to inlet header sheet 10, forming the assembly.

In a typical operation of a cooling system comprising the illustrated embodiment, a heat energized, coolant fluid stream such as a water-antifreeze mixture flows into inlet header tank 30 through inlet 35 and down stream through the longitudinally extending passages of the plurality of hollow energy exchange structures and into an outlet header assembly which is not shown. The flow of coolant through the exchange structures causes heat energy from the coolant to be dissipated to the energy exchange structures which in turn is then dissipated to air flowing past the exterior surface of the exchange structures. The outlet header assembly comprises an outlet through which the heat dissipated coolant flows to the heat generating automotive engine. The flowing coolant gains heat energy from the internal combustion process of the heat generating engine and is recycled to the inlet header tank by means of a water pumping device. A cooling system also typically comprises a venting means to the air such that the turbulence of the flow, occasioned by the action of the pumping device, the convoluted flow path and interior surface imperfections of the cooling system act to entrain air within the coolant fluid and also typically to form an air head within the system.

FIG. 2 comprises a sectional view of the assembled automotive radiator of FIG. 1, taken approximately along line 2—2. FIG. 2 illustrates the arrangement of ribs 33 comprised at tank attachment foot 32 of inlet header tank defining wall 34 in relationship to inlet header sheet 10. The exterior surface of tank attachment foot 32 of inlet header tank 30 is fitted within the confines of the area circumscribed by the interior surface of retaining wall 14 of inlet header sheet 10, such that ribs 33 are adjacent to the interior slot side 17 of attachment slot 16. The plurality of ribs 33 define multiple minor assembly crevices 26 at the assembly joint formed between inlet header tank 30, gasket 20 and inlet header sheet 10. Minor assembly crevices are distinguished from the previously discussed elongated assembly crevices by the presence of a plurality of interspaced rib crevices which segment and space the elongated crevice at the assembly joint which circumscribes the interior surface of tank defining wall 34.

FIG. 3 comprises an enlarged, partial fragmentary, sectional view taken approximately along line 3—3 of the embodiment illustrated in FIG. 1. This figure illustrates crevices of the invention at the assembly joint formed wherein tank attachment footer 32 engages attachment slot 16 with deflected gasket 20 therebetween. Gasket 20 is deflected by the downward force of crimping attachment end 15 of retaining wall 14. Rib crevice 25 is defined as comprising the area between rib surface 27, gasket interior side 23 and interior slot side 17. Minor assembly crevice 26 is defined as comprising the area between interior footer surface 28, gasket interior side 23 and interior slot side 17.

The minor assembly crevices of the invention are dimensioned to permit substantial mixing of fluid isolated within the crevice with fluid flowing through the radiator assembly. Generally, dimensioning which is adequate to provide substantial mixing varies with the flow of fluid through the assembly, the turbulence of the flow, viscosity of the fluid, and multiple other factors. Typically, an assembly joint between a header sheet and a header tank in an automotive radiator assembly wherein a coolant fluid comprising from about 30% to about 70% antifreeze and from about 70% to about 30% water is intended to be used, a plurality of ribs having sufficient depth to distance the interior surface of the footer an average of from about 0.025 to about 0.25 inches from the interior slot wall, having rib surfaces less than about 0.125 inches in average width have improved resistance to joint crevice corrosion. Ribs of sufficient depth to attain an average footer surface to interior slot wall distance of from about 0.030 to about 0.070 inches, having average widths of from about 0.050 to about 0.100 inches and average lengths therebetween of from about 0.20 to about 0.30 inches are preferred. One especially preferred embodiment has an average foot surface to wall slot surface distance of about 0.050 inches, average rib width of about 0.080 inches and a minor crevice length of about 0.250 inches.

We claim:

1. An improved method for reducing crevice corrosion in fluid handling devices wherein an aluminum surface of a first component is joined to a second component in a gasket sealed joint comprising an elongated assembly crevice, the improvement comprising providing a series of spaced ribs at said joint, said ribs being configured to intermittently resist engagement of said second component to said first component along said elongated assembly crevice sufficient to segment said elongated assembly crevice into a plurality of minor assembly crevices, interspaced between said ribs, a plurality of said minor crevices being dimensioned to permit substantial mixing of fluid isolated within said minor crevices with fluid being handled by the device.

2. The method of claim 1 wherein a rib surface engaging an aluminum surfaced component is dimensioned to resist formation of a crevice between said rib surface and said component of sufficient dimension to isolate fluid in a rib crevice.

3. The method of claim 1 wherein an aluminum first component engages a second component comprising polymeric or malleable metal materials.

4. The method of claim 3 wherein said second component comprises said ribs.

5. The method of claim 4 wherein an aluminum first component engages a polymeric second component comprising said ribs.

6. The method of claim 3 comprising an elastomeric gasket.

7. The method of claim 2 wherein said rib surface engaging said component is flat, rounded or an edge.

8. The method of claim 1 wherein said fluid comprises from about 30% to about 70% antifreeze.

9. The method of claim 1 comprising a plurality of ribs having sufficient depth to distance an aluminum crevice surface of said first component an average of from about 0.025 to about 0.25 inches from an opposing crevice surface of said second component.

10. The method of claim 1 comprising ribs having a rib surface less than about 0.125 inches in average width.

11. The method of claim 1 wherein said ribs are distanced to form a minor crevice therebetween from about 0.030 inches to about 0.50 inches in length.

12. The method of claim 9 having an average distance of from about 0.030 to about 0.070 inches.

13. The method of claim 10 having an average width of from about 0.050 to about 0.100 inches.

14. The method of claim 11 having an average distance therebetween of from about 0.20 to about 0.30 inches.

15. The method of claim 1 having an average distance of about 0.050 inches, an average rib width of about 0.080 inches and a minor crevice length of about 0.250 inches.

16. A header tank assembly comprising a header sheet joined to a header tank according to the method of claim 1.

17. A header tank assembly comprising a header sheet joined to a header tank according to the method of claim 2 wherein said first component comprises an aluminum header sheet, said second component comprises a header tank formed from polymeric material and comprises spaced ribs, and said gasket comprises an elastomer.

18. A header tank assembly for an automotive radiator comprising an aluminum heat exchanger header sheet, deformed to engage a polymeric header tank containing multiple inwardly extending spaced ribs, said tank and header being joined at a fluid tight, elastomeric gasket sealed, assembly joint comprising crevices extending between said mutiple ribs, and crevices being dimensioned to permit substantial mixing of fluid isolated within said crevices with fluid flowing through said radiator.

19. The assembly of claim 18 wherein a rib surface engaging said aluminum header is dimensioned to resist formation of a rib crevice between said rib surface and said header sheet of sufficient dimension to isolate fluid.

20. The assembly of claim 18 comprising a plurality of ribs having sufficient depth to distance an aluminum crevice surface of said first component an average of from about 0.025 to about 0.25 inches from an opposing crevice surface of said second component.

21. The assembly of claim 18 comprising ribs having a rib surface less than about 0.125 inches in average width.

22. The assembly of claim 18 wherein said ribs are distanced to form a minor crevice therebetween from about 0.030 inches to about 0.50 inches in length.

23. The assembly of claim 20 having an average distance of from about 0.030 to about 0.070 inches.

24. The assembly of claim 21 having an average width of from about 0.050 to about 0.100 inches.

25. The assembly of claim 22 having an average distance therebetween of from about 0.20 to about 0.30 inches.

26. The assembly of claim 18 having an average distance of about 0.050 inches, an average rib width of about 0.080 inches and a minor crevice length of about 0.250 inches.

* * * * *